US009027286B2

(12) United States Patent
Lane

(10) Patent No.: US 9,027,286 B2
(45) Date of Patent: May 12, 2015

(54) RETROFIT ROOF SYSTEM FOR CORRUGATED AND LOW PROFILE RIBBED METAL ROOF PANELS AND CLIP THEREFOR

(71) Applicant: Tim Alan Lane, Ravenna, OH (US)

(72) Inventor: Tim Alan Lane, Ravenna, OH (US)

( * ) Notice: Subject to any disclaimer, the term of this patent is extended or adjusted under 35 U.S.C. 154(b) by 0 days.

(21) Appl. No.: 14/080,624

(22) Filed: Nov. 14, 2013

(65) Prior Publication Data

US 2014/0130425 A1 May 15, 2014

Related U.S. Application Data

(60) Provisional application No. 61/726,284, filed on Nov. 14, 2012.

(51) Int. Cl.
*E04D 3/365* (2006.01)

(52) U.S. Cl.
CPC ..... *E04D 3/365* (2013.01)

(58) Field of Classification Search
USPC ..... 52/90.2, 22, 534, 506.01, 506.05, 52/506.06, 506.08, 512, 674, 698, 712, 52/90.1, 91.1, 91.3, 334–336, 478–480
See application file for complete search history.

(56) References Cited

U.S. PATENT DOCUMENTS

| | | | | |
|---|---|---|---|---|
| 4,034,135 | A * | 7/1977 | Passmore | 428/184 |
| 4,494,343 | A | 1/1985 | Berry et al. | |
| 4,894,967 | A * | 1/1990 | Morton | 52/334 |
| 5,142,838 | A * | 9/1992 | Simpson et al. | 52/640 |
| 5,187,911 | A * | 2/1993 | Cotter | 52/469 |
| 5,367,848 | A * | 11/1994 | McConnohie | 52/336 |
| 5,402,572 | A | 4/1995 | Schulte et al. | |
| 5,557,903 | A * | 9/1996 | Haddock | 52/508 |
| 5,600,971 | A * | 2/1997 | Suk | 52/713 |
| 5,743,063 | A * | 4/1998 | Boozer | 52/713 |
| 5,765,329 | A * | 6/1998 | Huang | 52/302.3 |
| 5,911,663 | A | 6/1999 | Eidson | |
| 6,415,581 | B1 * | 7/2002 | Shipman et al. | 52/798.1 |
| 6,470,644 | B2 * | 10/2002 | James et al. | 52/745.06 |
| 6,655,099 | B1 * | 12/2003 | Trenoweth | 52/243 |
| 7,174,686 | B1 * | 2/2007 | Legband | 52/471 |
| 7,861,480 | B2 | 1/2011 | Wendelburg et al. | |
| 7,987,647 | B2 | 8/2011 | Rymell et al. | |
| 8,024,906 | B1 | 9/2011 | Nelson et al. | |

(Continued)

OTHER PUBLICATIONS

Retreived from Internet www.cirrusconstruction.com/PDF/HighMOM5208Rev05.pdf on Sep. 23, 2013, Butler Manufacturing, High Profile Metal Over Metal Reroof System.
Retreived from Internet www.archmetalroof.com/metal-over-metal-retro-fit.html on Sep. 20, 2013 ABC-McElroy Metal, Metal Over Metal Retrofit.

(Continued)

*Primary Examiner* — Beth Stephan
(74) *Attorney, Agent, or Firm* — Zollinger & Burleson Ltd.

(57) ABSTRACT

A roofing system is installed over the top of existing corrugated metal roofs or over the top of low profile ribbed metal roofs as a retrofit roofing system. The system uses a clip specifically designed for corrugated and other forms of low-profile ribbed metal roof panels. The clip spans a single raised corrugation or single raised rib to provide a secure support for a roofing system to be disposed above the existing roof. The clips may be disposed at a plurality of locations along a purlin and are secured to the purlin through the existing roof panels with connectors. The connectors pass through spaced curved feet of the clip which fit into the spaced depressions of the corrugated roofing panel or the spaces adjacent to the low profile rib.

24 Claims, 6 Drawing Sheets

(56) References Cited

U.S. PATENT DOCUMENTS

| | | | | |
|---|---|---|---|---|
| 8,061,087 | B2 | 11/2011 | Ray | |
| 8,371,083 | B2 | 2/2013 | Chamberlin et al. | |
| 2001/0018816 | A1* | 9/2001 | Hoepker et al. | 52/783.17 |
| 2010/0275525 | A1 | 11/2010 | Wendelburg et al. | |
| 2012/0279165 | A1 | 11/2012 | Marshall | |

OTHER PUBLICATIONS

Corru-Fit Design Guide, Roof Hugger, Retrofit Solutions for Existing Corrugated Metal Roofs, Copyright 2012.

TopHat Quik-Clip Retrofit Solution for Corrugated 8, Low Profile Panels, Copyright 2013.

Roof Hugger Completes testing of Corru-Fit Retrofit Product, printed Oct. 29, 2012.

* cited by examiner

RETROFIT ROOF SYSTEM FOR CORRUGATED AND LOW PROFILE RIBBED METAL ROOF PANELS AND CLIP THEREFOR

CROSS REFERENCE TO RELATED APPLICATIONS

This application claims the benefit of U.S. Provisional Patent Application Ser. No. 61/726,284 filed Nov. 14, 2012; the disclosures of which are incorporated herein by reference.

BACKGROUND OF THE DISCLOSURE

1. Technical Field

The disclosure relates generally to a retrofit roofing system for use with corrugated metal roofs and low profile ribbed metal roofs, a method for retrofitting these roofs, and a clip for installing a retrofit metal roof over an existing corrugated metal roof or an existing low profile ribbed metal roof. The clip allows the retrofit roof to be installed on an existing roof even when the corrugations or ribs are inconsistently spaced or sized over the width of the roof.

2. Background Information

One of the oldest and most common metal roofing systems used in the United States uses corrugated metal panels supported on purlins. The corrugations are disposed perpendicular to the purlins and the panels overlap at their edges. Due to the age of many of these roof systems, many corrugated roof systems are due for replacement or retrofit. Various roof retrofit systems exist in the roofing art. Some of these systems use elongated spacers that define spaced notches which accommodate existing metal roof seams. The retrofit roof system is supported on top of these spacers. One such system is described in U.S. Pat. No. 7,861,480. These elongated spacers cannot be used effectively with corrugated metal roofing because the defined notches cannot be designed to accurately match up with the raised portions of the corrugations due to inconsistencies in the existing corrugated metal panels. In addition to corrugated metal panels, some existing roofs use low profile ribbed metal roof panels. Retrofitting such roofs also requires a system to install the retrofit roofing panels over the existing panels.

SUMMARY OF THE DISCLOSED EMBODIMENTS

The disclosure provides a roofing system that is installed over the top of existing corrugated metal roofs or over the top of low profile ribbed metal roofs as a retrofit roofing system. The system uses a clip specifically designed for corrugated and other forms of low-profile ribbed metal roof panels. The clip spans a single raised corrugation or single raised rib to provide a secure support for a roofing system to be disposed above the existing roof. The clips may be disposed at a plurality of locations along a purlin and are secured to the purlin through the existing roof panels with connectors. The connectors pass through spaced curved feet of the clip which fit into the spaced depressions of the corrugated roofing panel or the spaces adjacent to the low profile rib.

The roofing system disposed on the clips includes a plurality of channels disposed parallel to purlins on top of the clips. The channels have swedged ends that allow a plurality of these channels to be disposed end-to-end with lap joints without changing the upper level of the combined channels. The channel joints do not have to be directly supported by clips.

Deflection limiters may be used at selected locations of the roof system. The deflection limiters take the place of the clips and extend between the locations of purlins so that channels may be installed across the deflection limiters intermediate the purlin locations.

The clips, deflection limiters, and channels may be fabricated from 14 to 18 gauge steel or aluminum. The steel may be galvanized.

The system allows insulation to be disposed between the old roof and the new roof.

BRIEF DESCRIPTION OF THE DRAWINGS

Similar numbers refer to similar features throughout of the specification.

DETAILED DESCRIPTION OF THE DISCLOSURE

Figure 1:
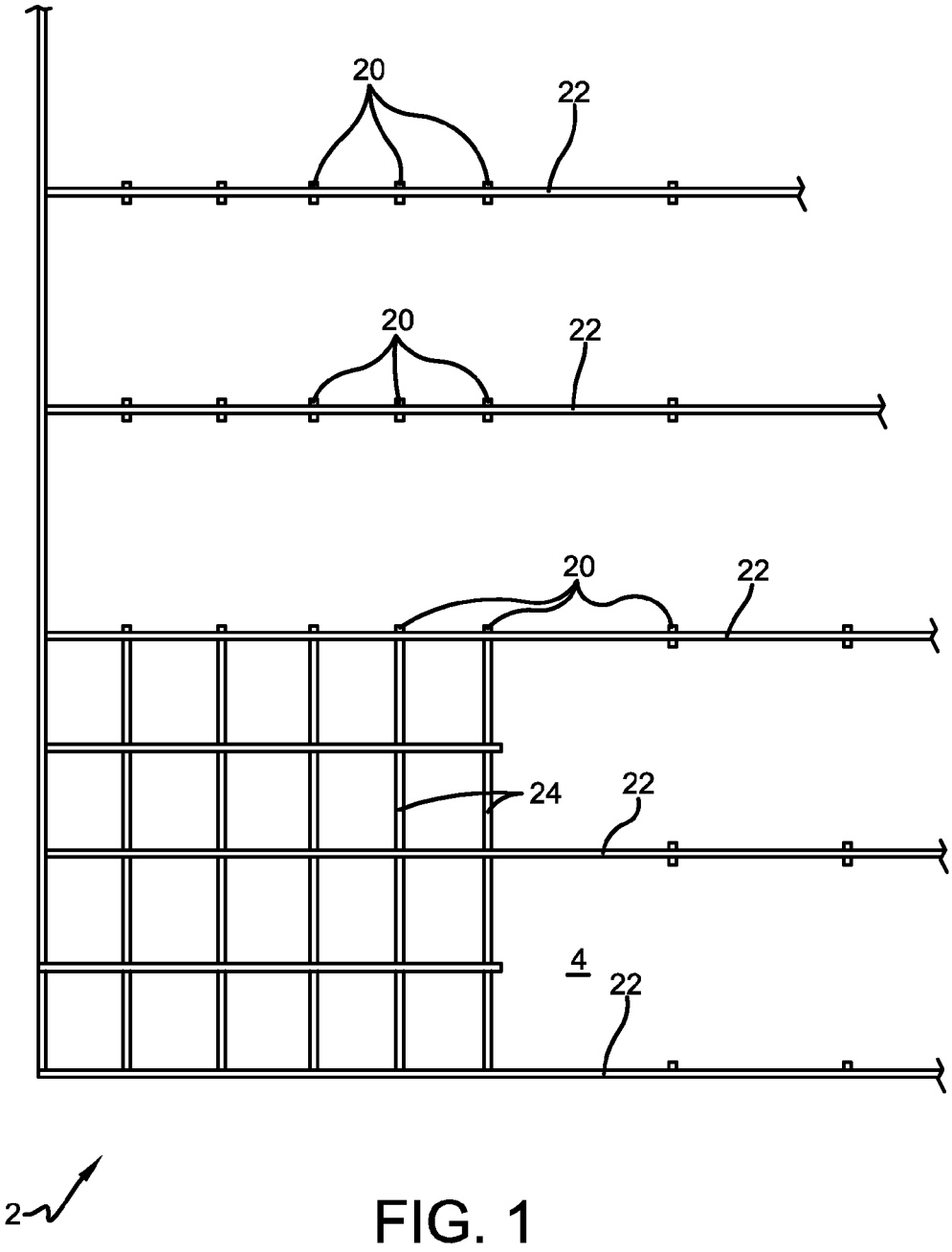
FIG. 1 is a top view of the roof system being used with an exemplary existing roof.

An exemplary configuration of a retrofit roofing system is indicated generally by the reference numeral 2 in the accompanying drawings. System 2 is used over the top of an existing corrugated metal or low-profile metal roofing system that generally includes a plurality of metal roof panels 4 installed on purlins 6. In the exemplary configuration, roof panels 4 are corrugated metal panels with each corrugation having a ridge 8 bounded by a pair of grooves 10. The spacing between ridges 8 is not necessarily constant and the exact size and shape of ridges 8 and grooves 10 are not necessarily the same across the width of panel 4 or from panel 4 to panel 4. As such, roof system 2 is configured to accommodate these differences while providing a strong base for a retrofit roof that is easy to install.

Figure 6:
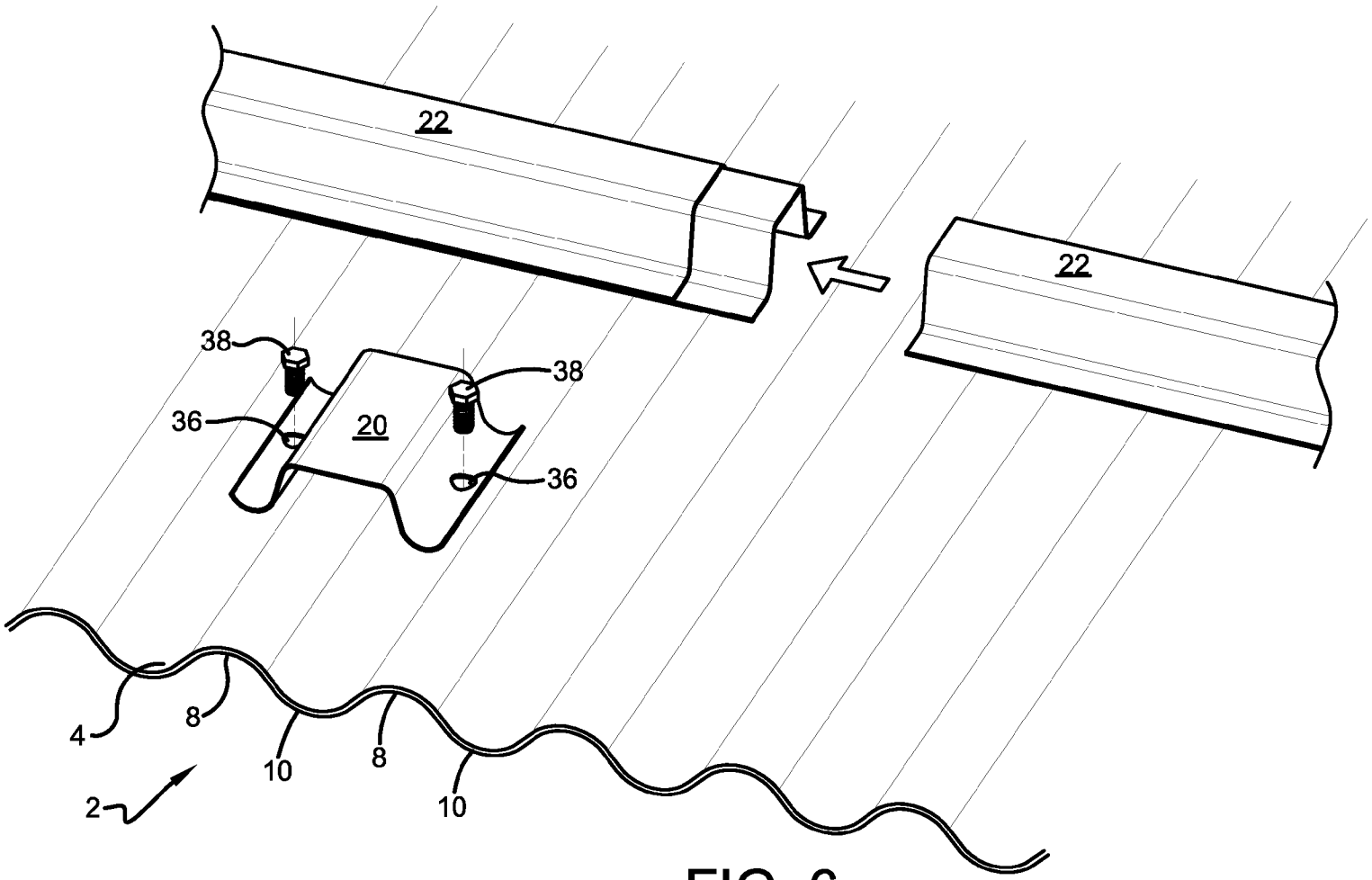
FIG. 6 is an exploded perspective view of the elements of the retrofit roofing system.
Figure 7:
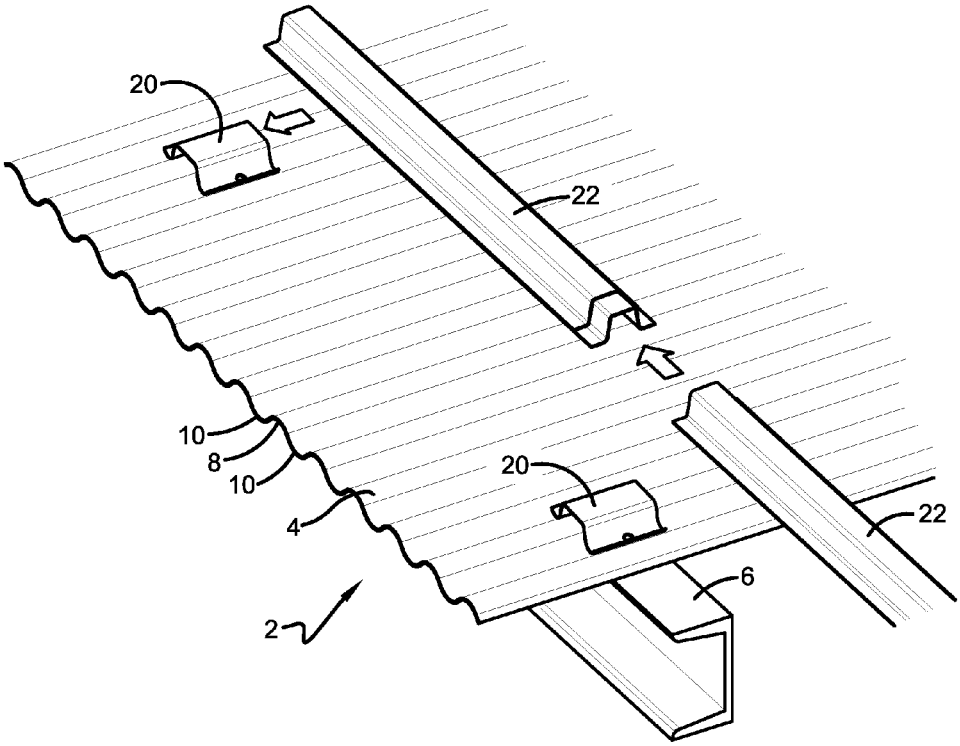
FIG. 7 is an exploded perspective view of the elements of the retrofit roofing system.

Roof system 2 generally includes a plurality of clips 20 that are secured to purlins 6 through roof panels 4. Clips are sized and used in a manner that allows system 2 to function with corrugations of various sizes. Channels 22 are disposed on clips 20 and are used to support the new roofing system. This provides room between the old roofing system and the new roofing system for insulation. A plurality of channels 22 may be joined end-to-end with lap joints as one end of each channel 22 is swedged (or necked down) to fit inside another channel 22 so that they fit may be fit together without changing the line of the upper surface of the joined channels 22. In the context of this description, the term 'swedged' means that one of the ends of channels 22 is thinned or offset so that it fits inside the other end of another channel 22 (the fit may be a frictional fit) in the manner shown in FIGS. 6 and 7. In one configuration, one end is thinned or offset so it is stepped down from the outer surface (shown in FIG. 3). In another configuration, one end is thinned or offset while the other end is also thinned or offset from the inside. The swedging of the channel ends allows channels 22 to be supplied in standard sizes and fit together at the job site as needed. The overlapping ends of channels 22 do not need to be positioned directly over a support such as a clip 20. This gives the installer flexibility during the installation and makes it easier to lay out the retrofit roofing system 2 because two channels 22 may be joined in an area between clips 20. This reduces the number of measurements and cuts required to install system 2. The new roof system or roof panels (not shown) are installed on top of channels 22.

As shown in FIG. 1, deflection limiters 24 may be provided in place of clips 20 in some locations of system 2. Deflection limiters 24 are elongated clips that run in a direction parallel to ridges 8 to allow channels 22 to be located at positions intermediate purlins 6. These are used in locations where additional support is desired such as the corners of a roof or in jurisdictions requiring additional support against wind. Each deflection limiter 24 has a shape when viewed in cross section that is similar to (and may be the same as) clip 20. Deflection limiters 24 may be provided in standard lengths that work with standard purlin 6 spacing.

Figure 2:
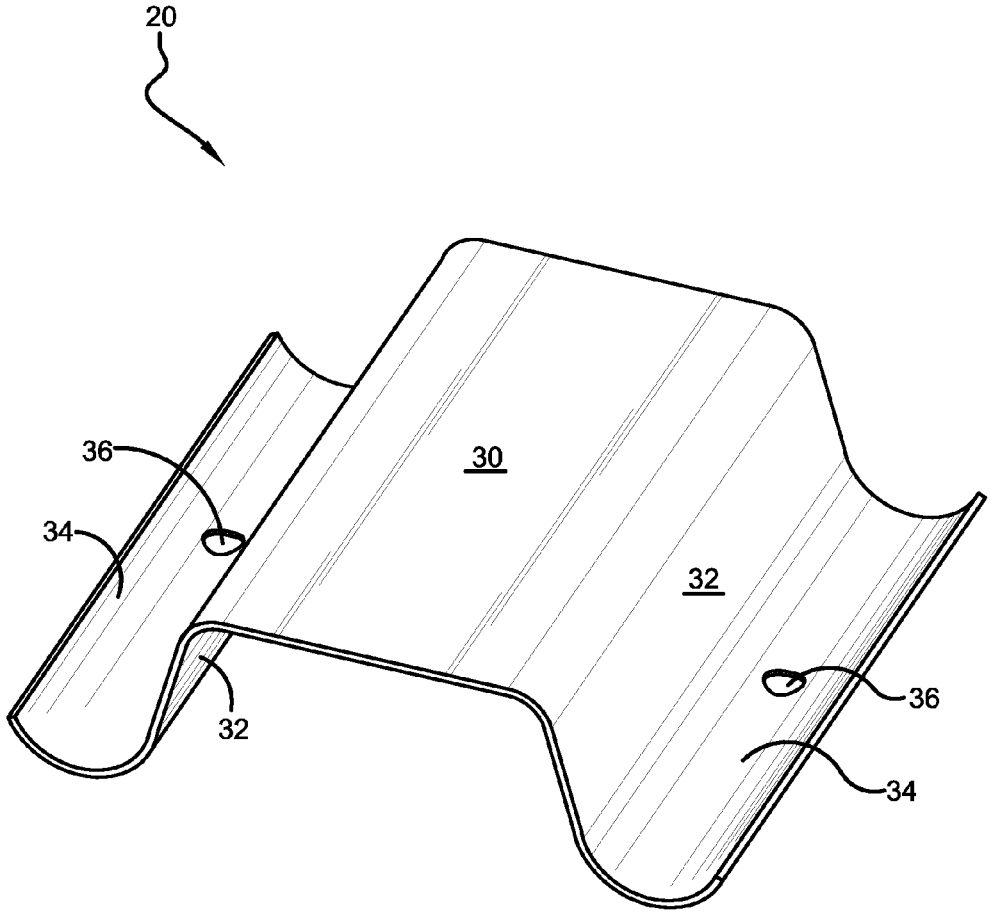
FIG. 2 is a perspective view of one of the clips used to support the channels above the existing roof panels from the purlins.
Figure 5:
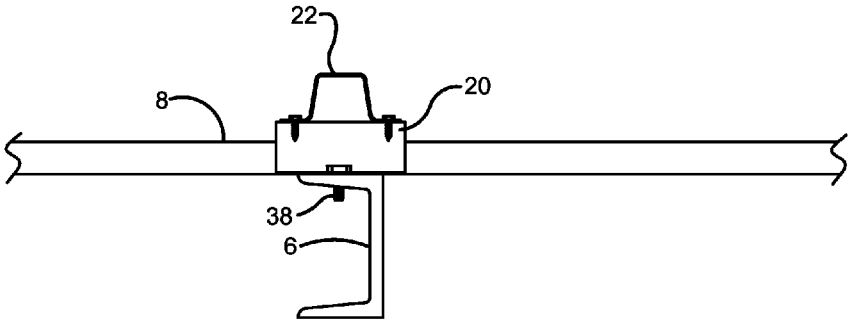
FIG. 5 is cross section taken parallel to the corrugations of the existing roof showing the relationship between the existing roof, the purlin, the clip, and the channel.

FIG. 2 depicts a clip 20 which has a generally flat support wall 30 (which may be grooved, indented, or dimpled for strength), a pair of legs 32 extending down from the longitudinal edges of wall 30, and a pair of curved spaced feet 34 disposed at the bottom of legs 32. Curved feet 34 are configured to fit into grooves 10 of roof panels 4. Each foot 34 defines a hole 36 sized to receive a connector 38 that is used to secure clip 20 through roof panel 4 to a purlin 6. The two connectors 38 prevent clip 20 from swiveling once installed. The two feet 34 and angled legs 32 provide a stable base for channels 22. Legs 32 are angled away from each other (five to twenty degrees out from vertical) and have a length sufficient to lift support wall 30 above ridge 8. Support wall 30 is wide enough to span ridge 8. Clips 20 may be provided in different sizes (both heights and widths) for different configurations of roof panels 4. Clip 20 has the a length at least as wide as channel 22 so that channel 22 is supported at both of its feet 40 as shown in FIG. 5. The deflection limiter has a cross section similar to the clips. The clips, deflection limiters, and channels may vary in size (height, width) depending on application. The cross sections of the elements change based on panel profiles and hat channel based on distance between clips. The clips, deflection limiters, and channels may be fabricated from 14 to 18 gauge steel or aluminum. The steel may be galvanized.

Connectors 38 may be self-tapping but may require a hole to be drilled through roof panel 4 and into purlin 6 prior to the installation of connector 38. Clips 20 may be located at evenly-spaced locations as depicted in FIG. 1 but their location may be shifted as needed depending on the conditions of the existing roof.

Figure 3:
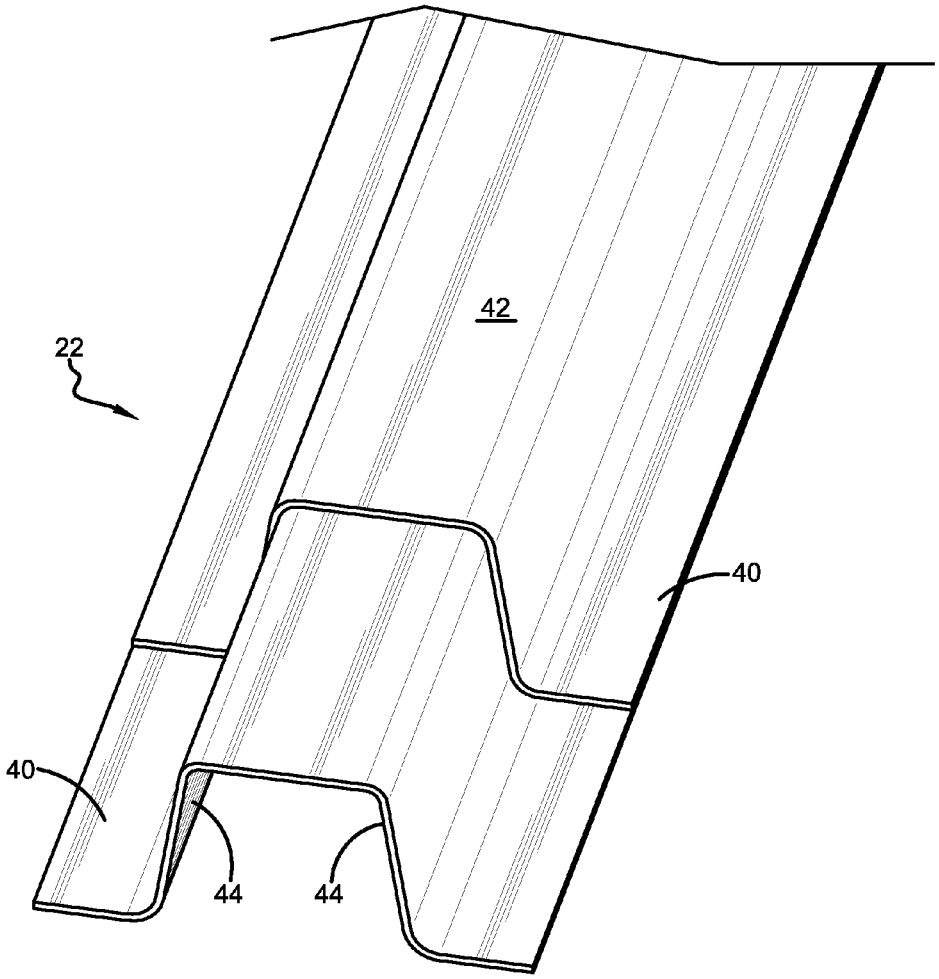
FIG. 3 is a perspective view of the swedged end of one of the channels.
Figure 4:
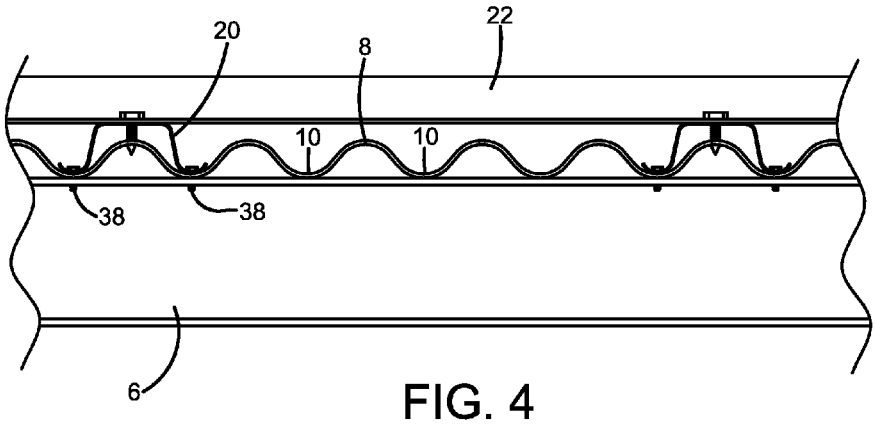
FIG. 4 is cross section taken perpendicular to the corrugations of the existing roof showing the relationship between the existing roof, the purlin, the clip, and the channel.

Each channel 22 has its own roof support wall 42 with legs 44 extending down from the edges of wall 42. Legs 44 are angled away from each other and terminate at feet 40. FIG. 3 shows the swedged end. The new roof panels are secured to support wall 42 in the manner required by the roof panels. A variety of new roof panels may be used.

Clips 20 and channels 22 may be fabricated from steel, stainless steel, aluminum, or other materials sufficiently strong to support the weight of the new roofing system being installed over the top of system 2.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A system for retrofitting an existing roof wherein the existing roof has a plurality of roof panels with each roof panel having a plurality of substantially parallel raised ridges; the roof panels being supported on spaced, substantially parallel structural purlins; the system comprising:

a plurality of clips; each of the clips having an upper support wall having a pair of longitudinal edges;

a leg extending down from each of the longitudinal edges; each of the legs having an upper end and a lower end; the upper end of each leg disposed at the upper support wall of the clip; and a curved foot extending from the lower end of each leg; the curved feet extending away from each other;

at least two of the clips being spaced apart and for being aligned in a direction substantially perpendicular to the raised ridges of the existing roof;

the two spaced apart and aligned clips for being disposed above a purlin;

each clip for being disposed over the top of a single raised ridge of the existing roof;

the feet for being disposed on opposite sides of the ridge; and a support channel extending between two of the spaced apart and aligned clips; the channel adapted to support new roof panels;

the support channel including a plurality of aligned channel members with overlapping ends; and the overlapping ends of the aligned channel members being disposed between the two spaced and aligned clips.

2. The system of claim 1, wherein the support channel includes a pair of feet; and a connector extends through each foot of the support channel into one of the clips.

3. The system of claim 1, further comprising a deflection limiter adapted to be disposed over a raised ridge of the existing roof; the deflection limiter adapted to extend between at least first and second purlins.

4. The system of claim 3, wherein an additional support channel is connected to the deflection limiter between the first and second purlins.

5. The system of claim 4, wherein each deflection limiter includes:

an upper support wall having a pair of longitudinal edges;

a leg extending down from each of the longitudinal edges; each of the legs having an upper end and a lower end; the upper end of each leg disposed at the upper support wall of the clip; and a curved foot extending from the lower end of each leg; the curved feet extending away from each other.

6. The system of claim 1, wherein each curved foot defines an opening adapted to receive a connector.

7. The system of claim 6, wherein each curved foot has an outer end; the outer end of the curved foot disposed intermediate the upper support wall of the clip and the portion of the curved foot that defines the opening.

8. A retrofit roof comprising:

an existing roof including a plurality of roof panels with each roof panel having a plurality of substantially parallel raised ridges;

the roof panels being supported on spaced, substantially parallel structural purlins;

a plurality of clips;

at least two of the clips being spaced apart and aligned in a direction substantially perpendicular to the raised ridges of the existing roof;

the two spaced apart and aligned clips being disposed above one of the purlins;

each clip being disposed over a top of a single one of the raised ridges of the existing roof;

each clip having a pair of feet disposed on opposite sides of the ridge; and a support channel extending between the two spaced apart and aligned clips; the channel adapted to support new roof panels.

9. The retrofit roof of claim 8, wherein the ridges are substantially perpendicular to the purlins.

10. The retrofit roof of claim 8, further comprising new roof panels connected to the support channel.

11. The retrofit roof of claim 10, wherein the support channel includes a plurality of aligned channel members; each of the channel members having two ends; and at least one of the ends of one of the channel members overlapping one of the ends of another of the channel members to define overlapping ends.

12. The retrofit roof of claim 11, wherein the overlapping ends of the aligned channel members are disposed between the two spaced and aligned clips.

13. The retrofit roof of claim 11, wherein the overlapping ends are swedged.

14. The retrofit roof of claim 8, further comprising a deflection limiter disposed over one of the raised ridges of the existing roof; the deflection limiter extending between two of the purlins.

15. The retrofit roof of claim 14, wherein an additional support channel is connected to the deflection limiter between the two purlins.

16. The retrofit roof of claim 8, wherein each clip includes:

an upper support wall having a pair of longitudinal edges;

a leg extending down from each of the longitudinal edges; each of the legs having an upper end and a lower end; the upper end of each leg disposed at the upper support wall of the clip; and the feet extending from the lower ends of the legs; the feet being curved and extending away from each other; each of the feet defining a through-opening adapted to receive a connector.

17. The retrofit roof of claim 8, wherein:

at least two other clips are spaced apart and aligned above another purlin;

a second support channel extending between the two other clips; and a new roof panel connected to the support channels.

18. A retrofit roof comprising:

an existing roof including a plurality of corrugated roof panels with each corrugated roof panel having a plurality of substantially parallel raised ridges;

the roof panels being supported on spaced, substantially parallel structural purlins;

a plurality of clips;

at least two of the clips being spaced apart and aligned in a direction substantially perpendicular to the raised ridges of the existing roof;

the two spaced apart and aligned clips being disposed above one of the purlins;

each clip being disposed over a top of a single one of the raised ridges of the existing roof;

each clip having a pair of feet disposed on opposite sides of the ridge;

a support channel extending between the two spaced apart and aligned clips; and a new roof panel carried by the support channel.

19. The retrofit roof of claim 18, wherein the support channel includes a plurality of aligned channel members; each of the channel members having two ends; and at least one of the ends of one of the channel members overlapping one of the ends of another of the channel members to define overlapping ends.

20. The retrofit roof of claim 19, wherein the overlapping ends of the aligned channel members are disposed between the two spaced and aligned clips.

21. The retrofit roof of claim 19, wherein the overlapping ends are swedged.

22. A retrofit roof comprising:

an existing roof including a plurality of roof panels with each roof panel having a plurality of substantially parallel raised ridges;

the roof panels being supported on spaced, substantially parallel structural purlins;

a plurality of clips;

at least two of the clips being spaced apart and aligned in a direction substantially perpendicular to the raised ridges of the existing roof;

the two spaced apart and aligned clips being disposed above one of the purlins;

each clip being disposed over a top of one of the raised ridges of the existing roof;

each clip having a pair of feet disposed on opposite sides of the ridge;

a support channel extending between the two spaced apart and aligned clips, the support channel including a plurality of aligned channel members; each of the channel members having two ends; and at least one of the ends of one of the channel members overlapping one of the ends of another of the channel members to define overlapping ends; and a new roof panel carried by the support channel.

23. The retrofit roof of claim 22, wherein the overlapping ends of the aligned channel members are disposed between the two spaced and aligned clips.

24. The retrofit roof of claim 22, wherein the overlapping ends are swedged.

* * * * *